United States Patent [19]

Björk

[11] Patent Number: 4,487,469

[45] Date of Patent: Dec. 11, 1984

[54] MOUNTING SOCKET FOR A PROXIMITY SWITCH

[75] Inventor: Hilmer Björk, Karlskoga, Sweden

[73] Assignee: Aktiebolaget Bofors, Bofors, Sweden

[21] Appl. No.: 401,292

[22] Filed: Jul. 23, 1982

[30] Foreign Application Priority Data

Aug. 31, 1981 [SE] Sweden ..... 8105121

[51] Int. Cl.[3] ..... H01R 13/625

[52] U.S. Cl. ..... 339/88 R; 339/188 R; 403/349

[58] Field of Search ..... 339/88 R, 93 R, 93 C, 339/93 L, 181 R, 181 C, 188 R, 188 C, 189 R, 189 L, 190, 90 R, 90 C, DIG. 2; 403/348, 349; 24/221 R; 411/437, 438, 427, 251, 259, 262

[56] References Cited

U.S. PATENT DOCUMENTS

| | | | |
|---|---|---|---|
| 3,422,977 | 1/1969 | Shaw | 24/221 R |
| 3,478,302 | 11/1969 | Chirumbolo | 403/349 |
| 3,901,574 | 8/1975 | Paullus et al. | 339/90 |
| 4,099,820 | 7/1978 | DeLano | 339/88 |
| 4,305,180 | 12/1981 | Schwartz | 339/90 R |
| 4,359,256 | 11/1982 | Gallusser et al. | 339/90 R |

FOREIGN PATENT DOCUMENTS

| | | | |
|---|---|---|---|
| 2323944 | 11/1974 | Fed. Rep. of Germany . | |
| 294770 | 2/1983 | Fed. Rep. of Germany | 403/349 |
| 2339948 | 8/1977 | France . | |

*Primary Examiner*—John McQuade
*Assistant Examiner*—Thomas M. Kline
*Attorney, Agent, or Firm*—Pollock, Vande Sande & Priddy

[57] ABSTRACT

This invention relates to a mounting socket for inductive proximity switches (1) of the type which comprises a number of guide pins (2) for cooperation with the socket when mounting and dismounting the proximity switch in the socket. The mounting socket comprises an inner, cylindric guide surface (10) corresponding to the body of the switch and this surface is provided with a number of guide slots (8), substantially in the longitudinal direction of the socket, for the guide pins (2) of the switch. The mounting socket also comprises a number of spring elements (16, 17, 18) which are arranged to cooperate with the guide pins (2) for locking the proximity switch at a very precisely defined position with respect to the sensed element (28). The spring elements (16, 17, 18) are formed by means of slots (19, 20, 21) having a substantially peripheral extension in a cylindric part (12) of an inner sleeve (5) seated in the housing. The slots (19, 20, 21) are provided with recesses at stop locations (23, 24, 25) corresponding to the guide pins (2) of the proximity switch when the proximity switch is located in its proper, locked position with respect to the sensed element (28).

8 Claims, 2 Drawing Figures

MOUNTING SOCKET FOR A PROXIMITY SWITCH

TECHNICAL FIELD

The present invention relates to a mounting socket for a proximity switch and more particularly to a mounting socket which permits a rapid mounting and exchange of the specific type of inductive proximity switch which for a proper function requires a very precisely defined position with respect to the element which is to be sensed.

BACKGROUND OF THE INVENTION

Inductive proximity switches are commonly used in various applications for controlling or sensing the position of for instance a machine element. Especially in military applications, the use of such proximity switches has increased due to the fact that the position of for instance the breech ring, the rammer or the screw mechanism of the gun should be controlled or sensed at different moments during firing of the gun.

The proximity switches are normally beam shaped and detachably mounted in specific mounting means or mechanical adjustment means located on the machine, fire arm, etc, on which the position of an element is to be sensed.

When mounting the proximity switch, it is very important that the range between the proximity switch sensing surface and the sensed machine element, the adjustment range, is very precisely adjusted.

In the Swedish Patent Application No. 80.06265-6, a proximity switch as well as a mounting socket for the switch are illustrated. The mounting socket permits a rapid mounting and exchange of the proximity switch without any new adjustment of the range required. This is an important advantage as repeated adjustments of the range often are difficult and time-consuming actions due to the fact that proximity switches often are badly located on the machine from the service point of view and also due to the fact that it is often necessary to move the machine element which is to be sensed in its moving cycle. In said Swedish patent application, the rapid mounting and exchange of the proximity switch is carried out by means of an additional sleeve disposed on the switch member at a very precise range from the sensing surface of the switch. When mounting the proximity switch in its mounting socket, the sleeve is arranged to cooperate with the mounting socket in a predetermined way. As the mounting socket is located at a precisely defined range with respect to the machine element which is to be sensed, this also means that all proximity switches will be properly adjusted.

The mounting means that are illustrated in said Swedish patent application are all directly connected to the specific type of proximity switches that are provided with external threads on which an additional sleeve can easily be arranged. There is now disclosed herein, however, a new type of proximity switch which also has a cylindric body but instead of such external threads, the switch is provided with a number of guide pins extending out from the body of the switch to facilitate the mounting of the switch. These guide pins at the same time also make the above described mounting socket unsuitable.

Another disadvantage with the above type of mounting socket is the fact that the proximity switch after it has been thread into the socket also must be affixed or locked to the socket, which means that a further component, such as a clamp nut or the like, must be included.

SUMMARY OF THE INVENTION

The object of the present invention is accordingly to provide a proximity switch having such guide pins with a mounting socket which facilitates the exchange and mounting of the proximity switch. According to the invention, the mounting socket comprises a cylindric guide surface corresponding to the body of the switch and provided with a number of guide slots, corresponding to the guide pins, and a number of spring elements arranged to cooperate with the guide pins in order to lock the switch at a very precisely defined range from the element which is to be sensed.

In one preferred embodiment of the invention the mounting socket is made of two parts, an outer housing and an inner sleeve which comprises a spring element part. The spring elements are arranged in such a way that any resilient movement of the switch towards the controlled element is prevented when the switch is seated in its locked position.

BRIEF DESCRIPTION OF THE DRAWINGS

In the following, the invention will be more fully described with reference to the accompanying drawings in which.

DESCRIPTION OF BEST MODE AND OTHER EMBODIMENTS

Figure 1:
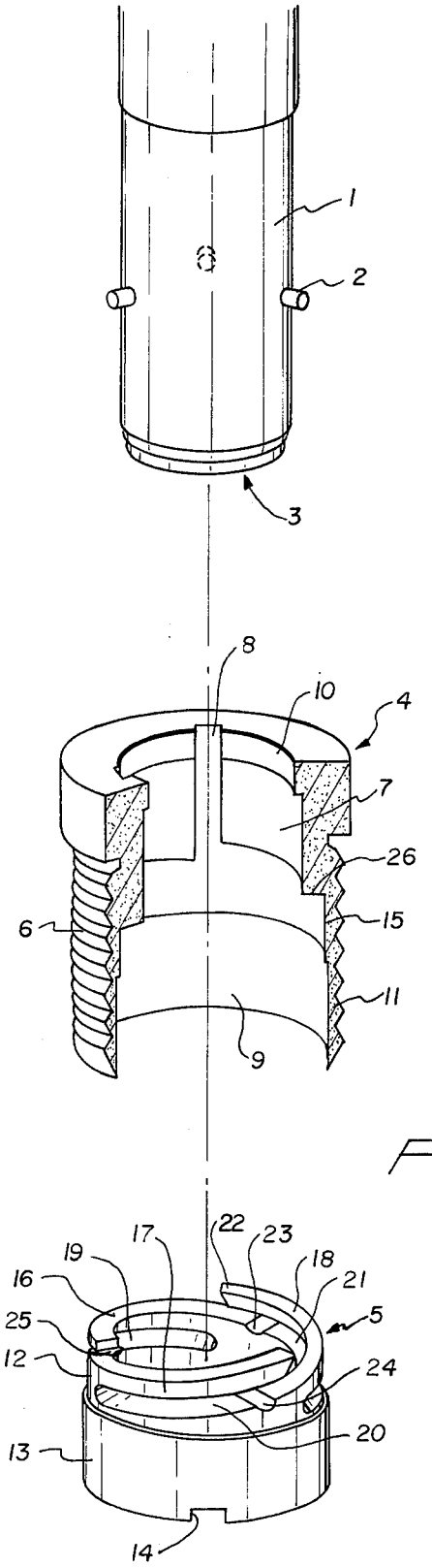
FIG. 1 is a schematic view of the different parts of the mounting socket and a corresponding proximity switch.

FIG. 1 shows an inductive proximity switch 1 in the form of a cylindric beam or rod provided with three guide pins 2 symmetrically arranged about the periphery of the beam body in order to allow the proximity switch to be mounted in a mounting socket arranged on a machine part for sensing a movable machine element. It is then necessary to mount the proximity switch in such a way that the sensing surface 3 of the proximity switch will be located at a very precisely defined range from the element which is to be sensed.

In FIG. 1 it is shown that the mounting socket which is cooperating with the proximity switch comprises two parts, an outer housing 4 and an inner sleeve 5. The housing 4 comprises an external thread 6 for mounting the socket on the machine part of which an element is to be sensed. Alternatively, the housing 4 may also be provided with a flange or the like and screwed on the machine part in question.

The housing 4 of the mounting socket is substantially made as an open tube or sleeve and comprises an upper part 7 and a lower part 9 in which the internal diameter is made larger than the upper part in order to admit the inner sleeve 5. The upper part 7 is provided with three longitudinal slots 8 corresponding to the guide pins on the proximity switch. The upper part 7 is also provided with an upper guide ring surface 10 corresponding to the cylindric body of the proximity switch. The lower part 9 comprises a lower cylindric seat 11 which corresponds to the inner sleeve 5.

The inner sleeve 5 is also substantially made as an open tube and comprises a spring element part 12 and a slightly larger part 13 tightly fitted to the cylindric seat 11 of the housing 4. The lower end of the larger part 13 is provided with a number of recesses 14 for securing the inner sleeve to the housing 4 by pressing material from the lower edge 9E of the housing into said recesses. In this way the housing and the inner sleeve can be mounted into one unit, the mounting socket, in one step without any additional adjustments required.

The spring element part 12 is also substantially cylindric and is arranged to be seated in a somewhat smaller part 15 of the lower part 9 of the housing 4. The spring elements 16, 17 and 18 are formed by means of slots 19, 20 and 21 made in the sleeve part 12. The slots are slightly inclined and are extending from the upper end surface 22 of the sleeve downwards to the somewhat larger, lower part 13 of the sleeve. The width of the inclined slots is slightly smaller than the diameter of the guide pins and each of the slots is provided with a stop location 23, 24, 25 which corresponds to the guide pins when the proximity switch assumes its proper, sensing position with respect to the element which is to be sensed. The slots have a peripheral extension of about one third of the periphery of the sleeve part 12.

The longitudinal guide slots 8 and the spring-loaded, inclined slots 19, 20 and 21 form a so-called bayonet coupling for the proximity switch. The spring elements 16, 17 and 18 efficiently secure the guide pins in their stop locations. It should be pointed out, however, that the stop locations 23, 24 and 25 are located in the slots in such a way that any resilient movement towards the sensed element is prevented, i.e. when the proximity switch is located in its secured stop location only a movement backwards out from the socket is possible. In this way it is prevented that the sensing surface of the proximity switch will come too close to the element which is to be sensed.

In order to prevent overloading of the spring elements when mounting and especially when dismounting the proximity switch, the flange 26 between the upper and lower parts of the housing 4 is formed as a mechanical stop for the spring elements against any excess motion backwards.

Figure 2:
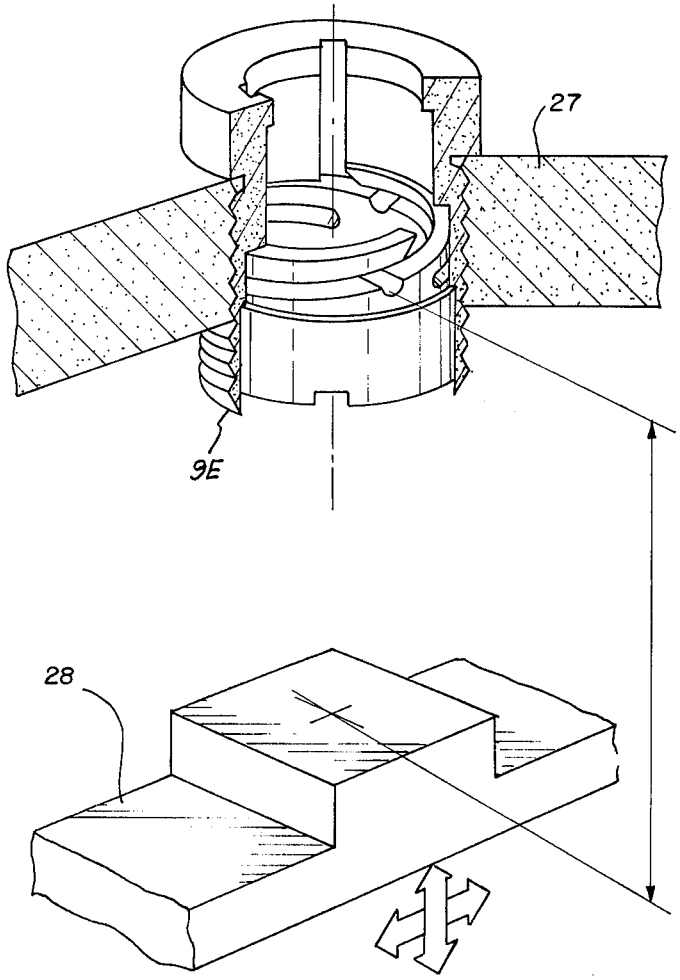
FIG. 2 shows the mounting socket arranged on a machine part of which a reciprocating machine element is to be sensed.

FIG. 2 illustrates the mounting socket mounted and screwed into a machine part 27 for sensing a reciprocating machine element 28. As already mentioned, it is important that the sensing surface 3 of the proximity switch is located at a very precisely defined range from the machine element which is to be sensed. This is fulfilled by the fact that the guide pins 2 are located at a specific distance from the sensing surface 3 of the switch, and that the mounting socket is so adjusted with respect to the element 28 which is to be sensed that the sensing surface of the switch assumes its proper position with respect to the sensed element when the switch is located in its stop location. As the guide pins and the mounting socket already from the beginning are accurately positioned with respect to the adjustment range, any following mounting or exchange of the switch can be carried out without any change of the adjustment range. It is also evident from the figure that the stop locations are located in such a way that any resilient movement is prevented in the direction towards the element which is to be sensed.

The proximity switch can be mounted rapidly and easily by feeding the switch from above into the mounting socket so that the guide pins follow the corresponding slots 8 in the housing 4 to a stop position in which the guide pins contact the upper end surface 22 of the inner sleeve 5. The proximity switch is then turned clockwise so that the guide pins go into and follow the guide slots 19, 20 and 21 formed by the spring elements 16, 17 and 18. The turning movement is stopped when the guide pins are located in their stop locations within recesses 23, 24 and 25.

The proximity switch can also be dismounted easily by first a movement axially somewhat backwards and then a movement counter clockwise out of the stop locations and then pulled axially out of the mounting socket.

The invention is not limited to the above embodiment but can be modified within the scope of the following claims. In the illustrated embodiment, the proximity switch is provided with three symmetrically arranged guide pins and therefore the mounting socket is also provided with three guide slots in the housing and in the sleeve which corresponds to the respective guide pins. It is realized that also other types of proximity switches with another number of guide pins and corresponding guide slots could be used. It is also realized that the construction of the slots 19, 20 and 21 and thereby the spring elements could be varied all the way from slots which are substantially perpendicular to the longitudinal axis of the mounting socket to slots which are substantially parallel to said axis.

What is claimed is:

1. A mounting socket for an inductive proximity switch of the type having a plurality of guide pins on an outer cylindrical wall for cooperating with the mounting socket when mounting and dismounting the switch in the socket and for locking the switch at a defined distance from an element to be sensed, said mounting socket comprising:

a housing having a plurality of guide slots corresponding in number to the guide pins of the switch and located on an inner cylindrical wall for guiding the proximity switch towards and away from said sensed element, and, a spring part positioned in said housing and having a plurality of resilient spring elements corresponding in number to the guide pins of the switch, said spring elements being arranged to cooperate with the guide pins so as to lock the proximity switch in a stop position at a fixed precisely defined distance from the sensed element in which stop position movement of the switch towards the sensed element is prevented while movement of the switch away from the sensed element against the resilience of the spring elements is permitted.

2. A mounting socket according to claim 1 in which said housing is substantially an open tube comprising a first part provided with a cylindric guide surface corresponding to the outer cylindrical wall of the proximity switch and a second part in which an internal diameter is made larger than an internal diameter of said first part in order to admit an inner sleeve comprising said spring part.

3. A mounting socket according to claim 2 in which said guide slots are substantially parallel to the longitudinal axis of the socket and are made in a wall of said first part.

4. A mounting socket according to claim 1 in which said housing comprises substantially an open tube and said spring part comprises an inner sleeve, and in which said spring part is substantially cylindric and said spring elements are formed by slots having a substantially peripheral extension in a wall of the inner sleeve.

5. A mounting socket according to claim 4 in which said slots are inclined and extend downwards in said wall of the inner sleeve from an upper end surface of the inner sleeve so as to form a connection with said guide slots.

6. A mounting socket according to claim 4 in which said slots are provided with stop locations for receiving the guide pins of the proximity switch so as to lock the proximity switch in said precisely defined stop position with respect to said sensed element.

7. A mounting socket according to claim 2 in which said first and second parts of the housing are separated by a flange arranged to form a mechanical stop for said spring elements opposing excess motion of said spring elements in a direction away from said sensed element.

8. A mounting socket according to claim 6 in which the width of said slots is slightly smaller than the diameter of said guide pins and said stop locations comprise recesses in said spring part for receiving said guide pins.

* * * * *